US006353670B1

(12) United States Patent
Gasner

(10) Patent No.: US 6,353,670 B1
(45) Date of Patent: Mar. 5, 2002

(54) ACTIVELY CONTROL SOUND TRANSDUCER

(76) Inventor: Donald R. Gasner, 21317 Halldale Ave., Torrance, CA (US) 90501

( * ) Notice: Subject to any disclaimer, the term of this patent is extended or adjusted under 35 U.S.C. 154(b) by 0 days.

(21) Appl. No.: 08/920,545

(22) Filed: Aug. 27, 1997

Related U.S. Application Data

(63) Continuation-in-part of application No. 08/674,436, filed on Jul. 2, 1996, now abandoned.

(51) Int. Cl.[7] ..... H04R 3/00
(52) U.S. Cl. ..... 381/96; 381/59
(58) Field of Search ..... 381/59, 26, 345, 381/346, 347, 348, 353, 354, 98, 89, 338, FOR 146

(56) References Cited

U.S. PATENT DOCUMENTS

| | | | | |
|---|---|---|---|---|
| 2,256,270 | A | 9/1941 | Swift | |
| 2,993,091 | A | 7/1961 | Guss | |
| 3,194,340 | A | 7/1965 | Kuwayana | |
| 3,978,940 | A | 9/1976 | Bouyoucos | |
| 4,074,224 | A | 2/1978 | Laurent | |
| 4,127,751 | A | 11/1978 | Kinoshita | |
| 4,196,792 | A | 4/1980 | Greives et al. | |
| 4,480,333 | A | 10/1984 | Ross | |
| 4,527,282 | A | 7/1985 | Chaplin et al. | |
| 4,589,133 | A | 5/1986 | Swinbanks | |
| 4,677,677 | A | 6/1987 | Eriksson | |
| 4,714,133 | A | 12/1987 | Skaggs, Jr. | |
| 4,928,788 | A | 5/1990 | Erickson | |
| 5,058,173 | A | 10/1991 | Ashworth | |
| 5,229,556 | A | 7/1993 | Geddes | |
| 5,251,262 | A | 10/1993 | Suzuki et al. | |
| 5,327,504 | A | 7/1994 | Hobelsberger | 381/96 |
| 5,396,561 | A | 3/1995 | Popovich et al. | |
| 5,461,676 | A | * 10/1995 | Hobelsberger | 381/96 |

FOREIGN PATENT DOCUMENTS

| | | | |
|---|---|---|---|
| JP | 0090491 | 5/1984 | 381/96 |
| JP | 0153398 | 9/1984 | 381/96 |
| WO | 8400274 | 1/1984 | 381/96 |

OTHER PUBLICATIONS

Graf, Rudolf F., ModernDictionary of Electronic, Howard W. Sams & Co., Sixth Edition, p. 687, 1984.*

* cited by examiner

*Primary Examiner*—Xu Mei
(74) *Attorney, Agent, or Firm*—Jaeckle Fleischmann & Mugel, LLP

(57) ABSTRACT

A speaker 20 has a cavity 28 that has dynamic pressure actively controlled by a pressure control device 42. The control circuit 40 may be analog or digital, open loop, closed loop, or a hybrid open closed loop design. In the closed loop and hybrid versions one or more sensors generate signals for a control circuit 40. In the open loop version predetermined signals independent of cavity pressures drive device 42 and sensors are not used. The pressure control device can alter changes in the dynamic pressure in the cavity 28 to reduce distortion of the sound transducer T1; or produce a multitude of effects on the output of T1 such as maximums and minimums over arbitrary bands, a flat response, simulated passive cavity effects, or other effects not possible with passive cavity designs. The cavity is actively driven to produce arbitrary cavity waves or pressure effects. In this way any arbitrary passive cavity design may be simulated. Additionally other effects not generally practical with passive designs can also be produced, such as resonance at a specific frequency of choice, or resonance over a range of frequencies; minimums and nulls; and simulation of the nulled cavity (vacuum), or the ideal enclosure.

56 Claims, 14 Drawing Sheets

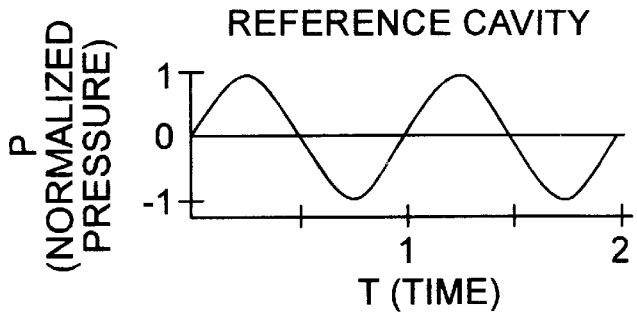
FIG. 2.01
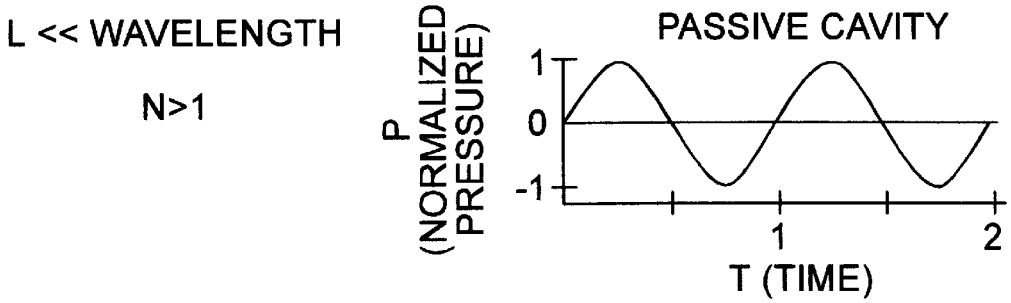
FIG. 2.02
(PRIOR ART)
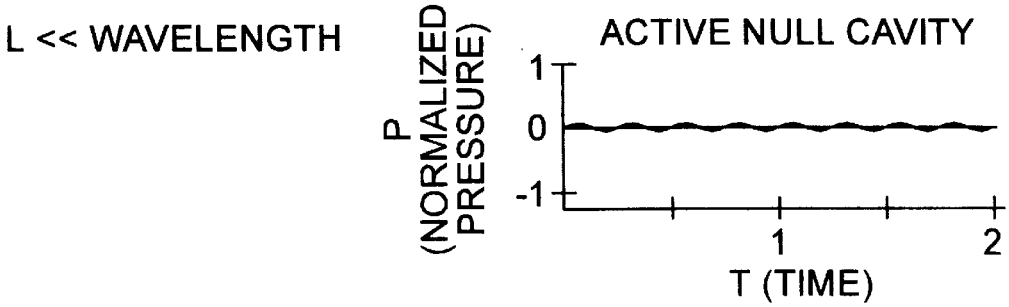
FIG. 2.1

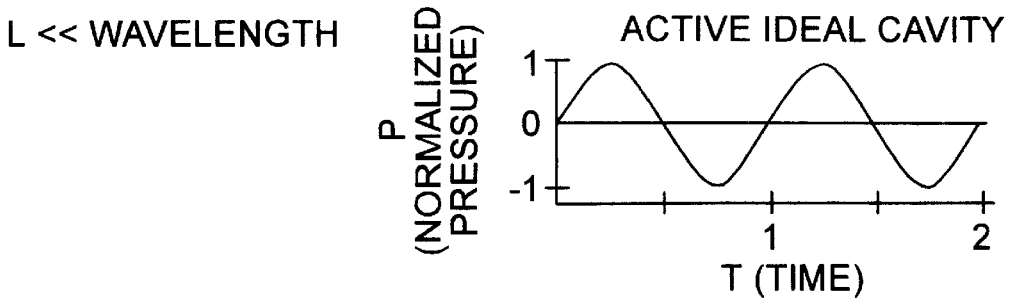
FIG. 2.2
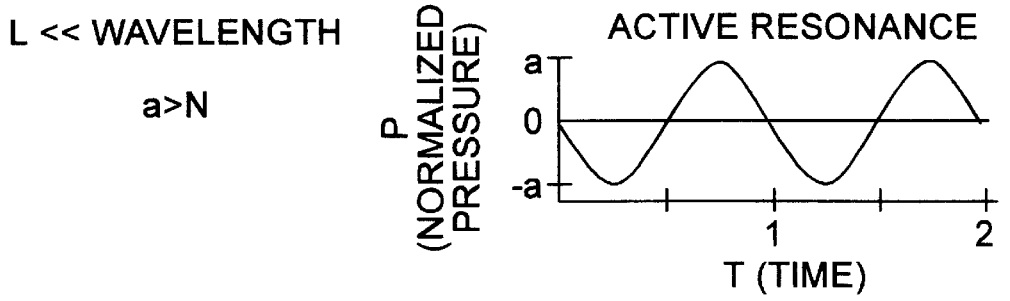
FIG. 2.3
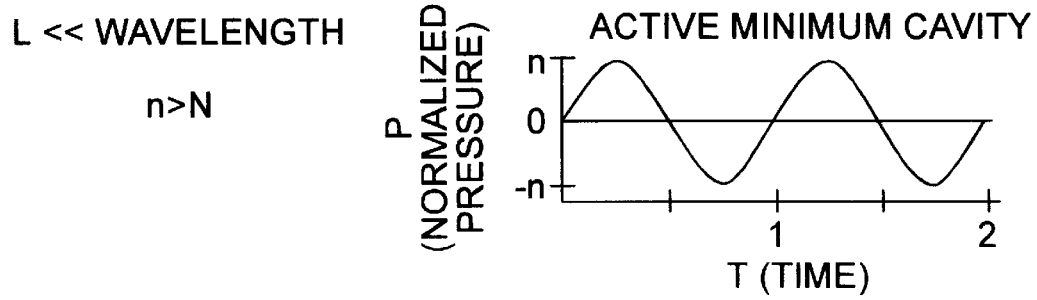
FIG. 2.4

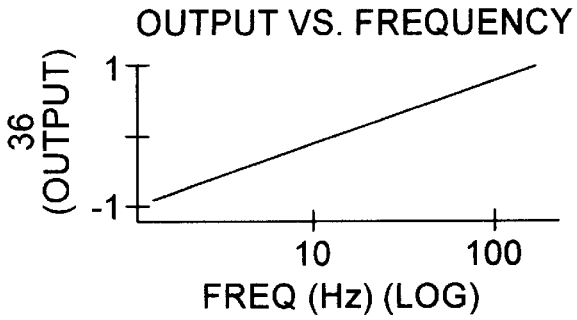
FIG. 3.01a
(PRIOR ART)
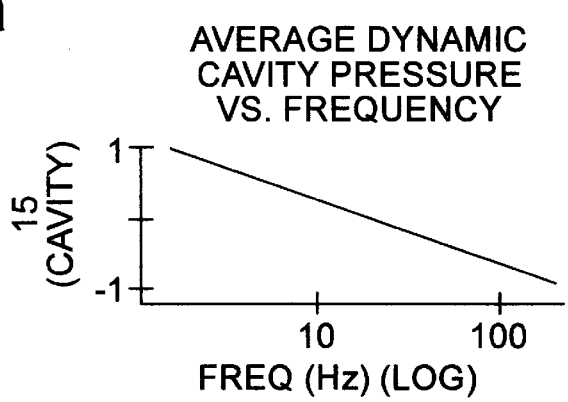
FIG. 3.01b
(PRIOR ART)
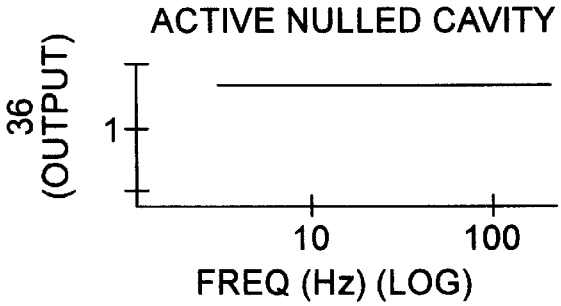
FIG. 3.1a
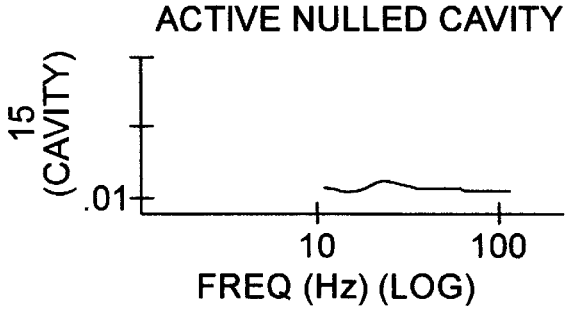
FIG. 3.1b

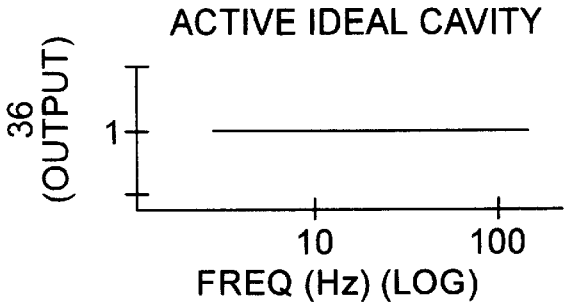
FIG. 3.2a
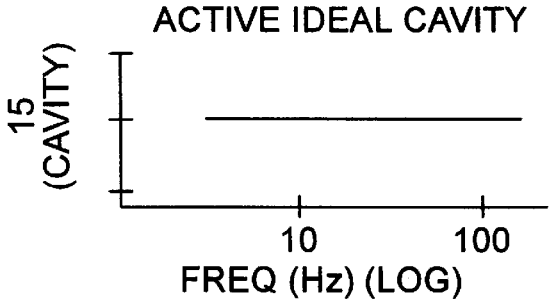
FIG. 3.2b
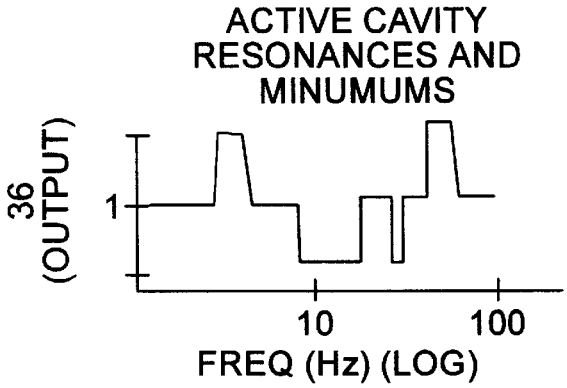
FIG. 3.3a
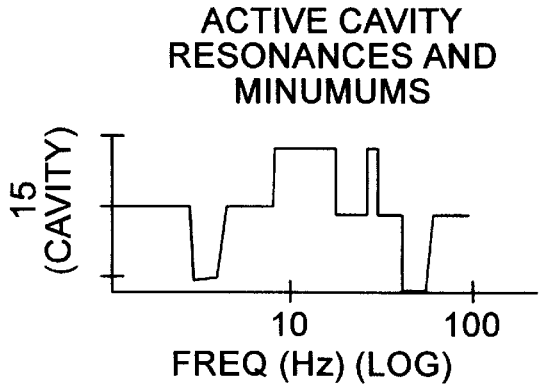
FIG. 3.3b

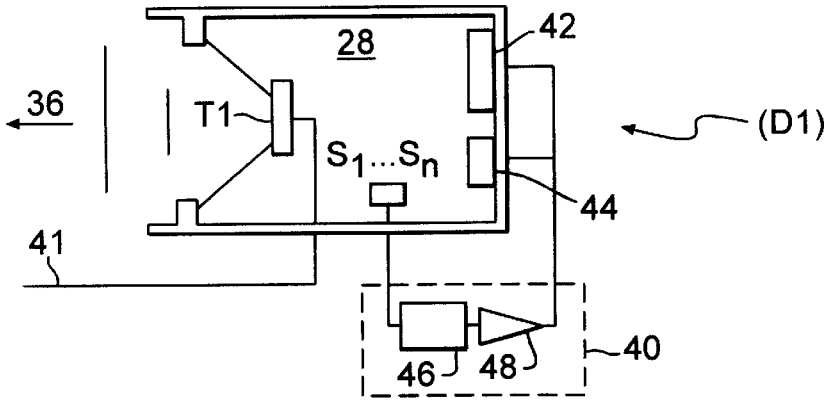
FIG 4.1
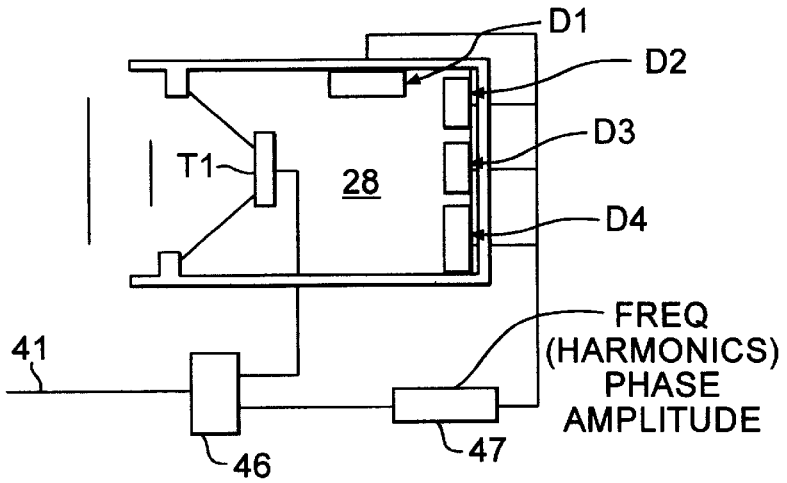
FIG 4.2
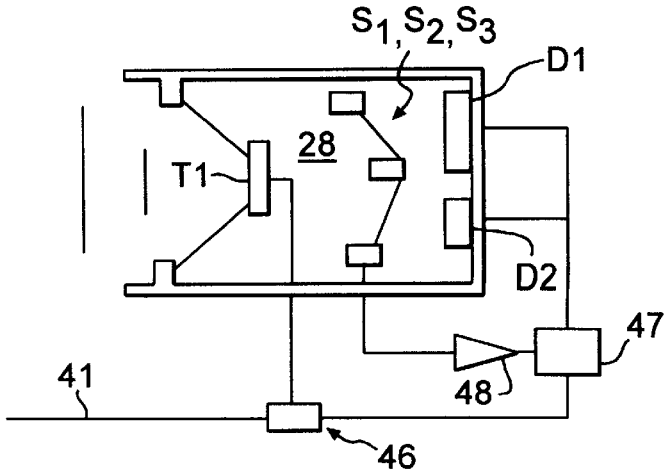
FIG 4.3

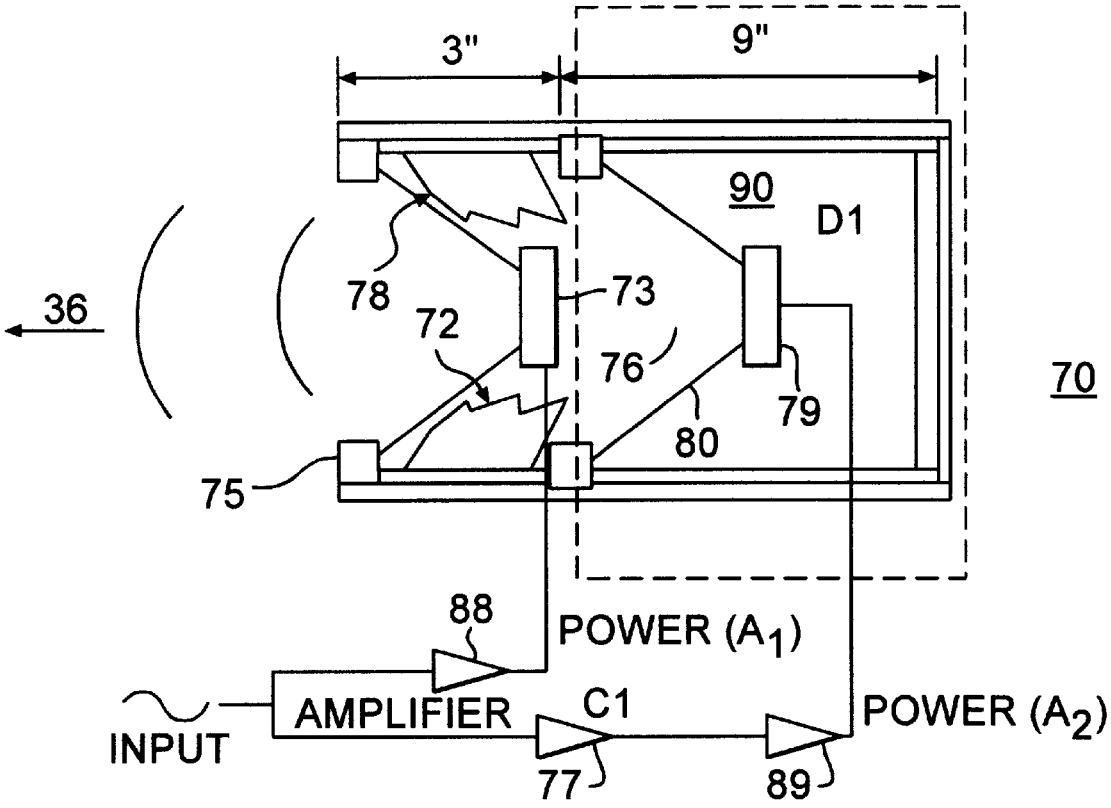
FIG. 5.1

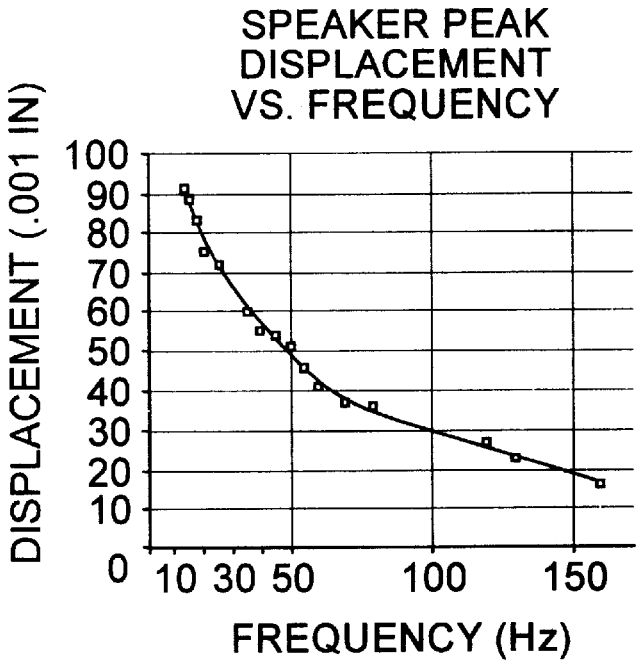
FIG. 5.2a
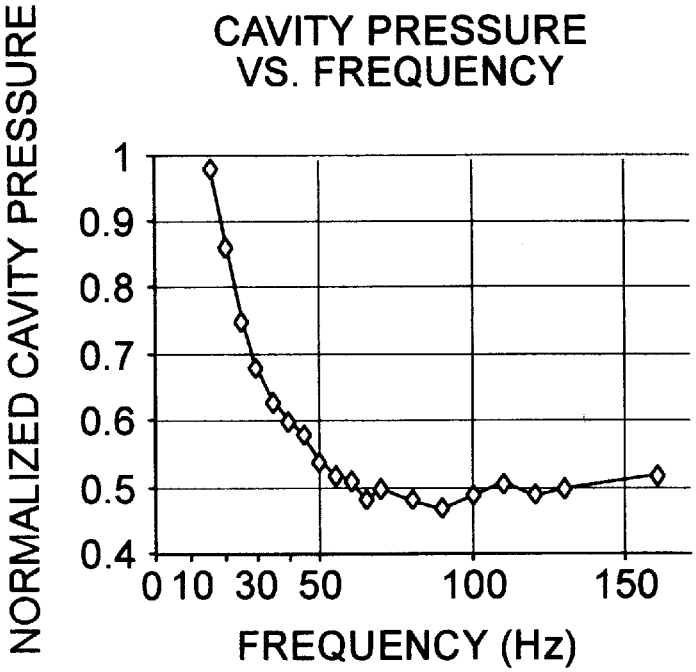
FIG. 5.2b

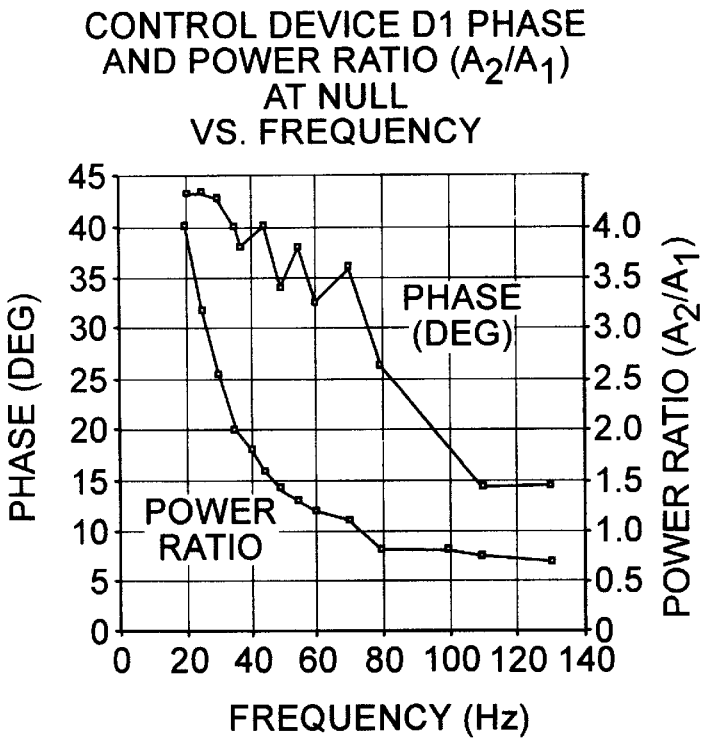
FIG. 6.1
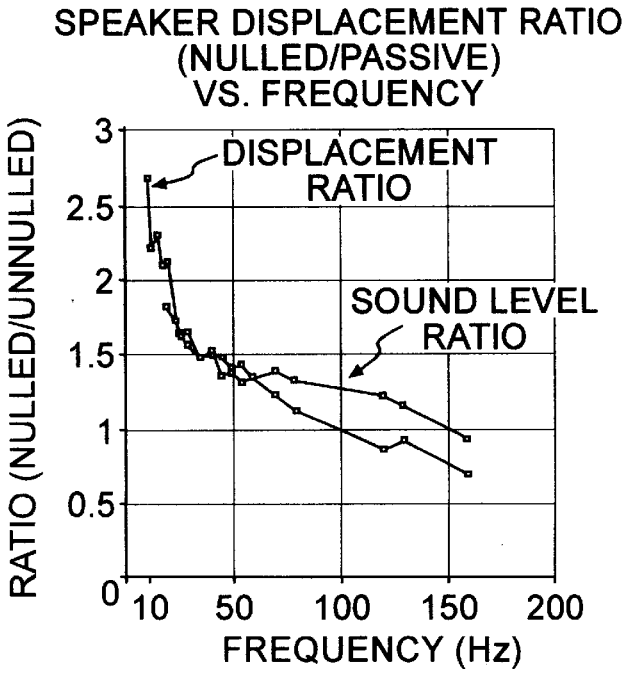
FIG. 6.2

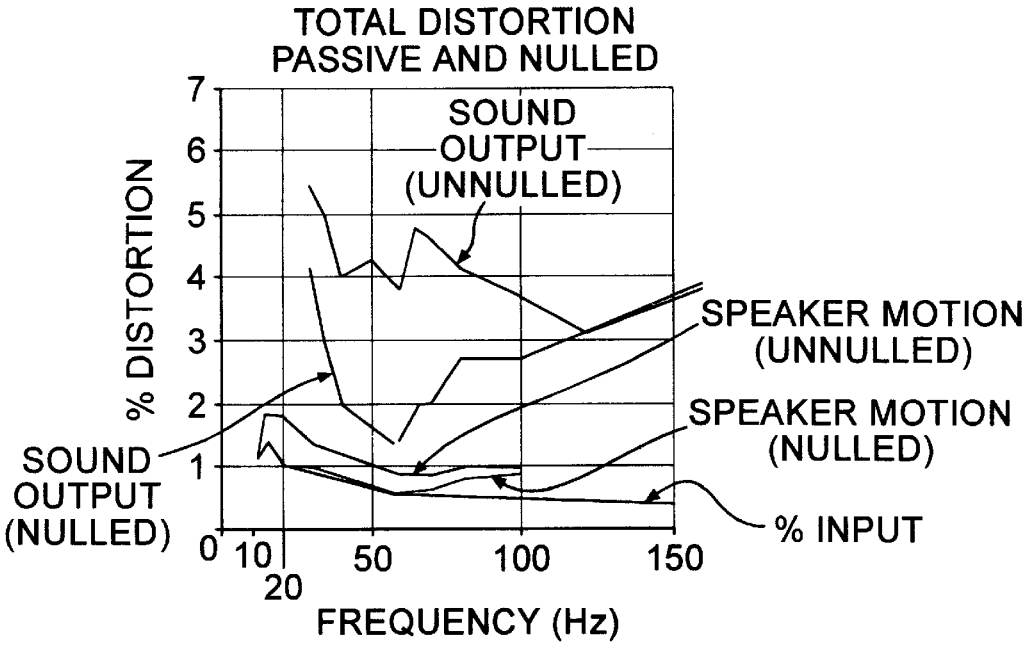
FIG. 6.3
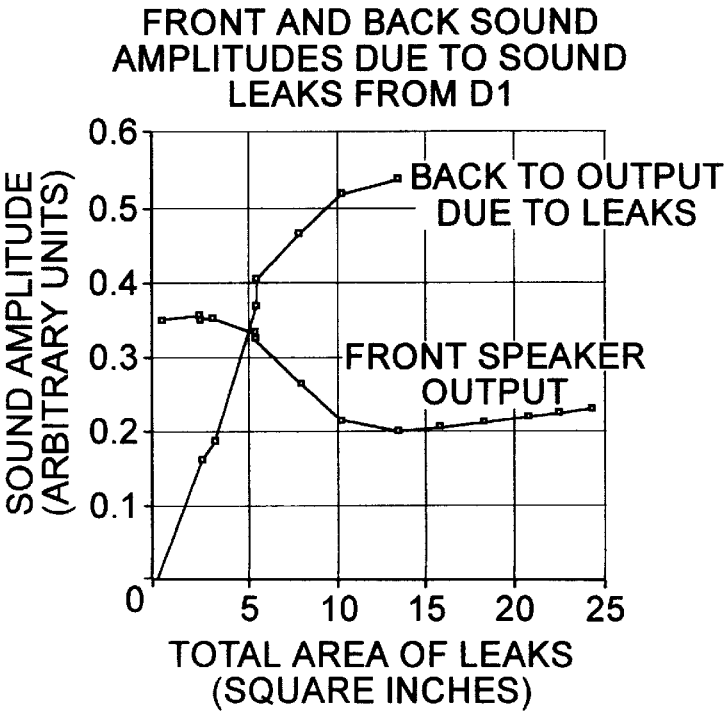
FIG. 6.4

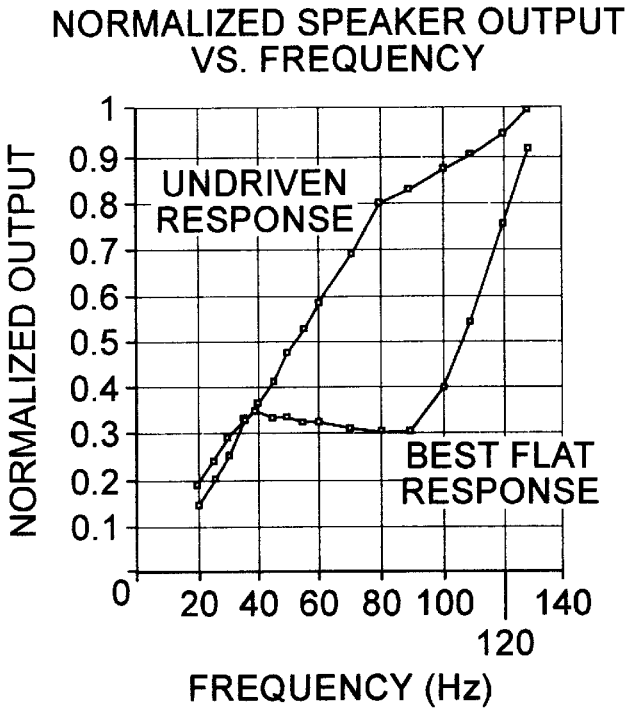
FIG. 7.1
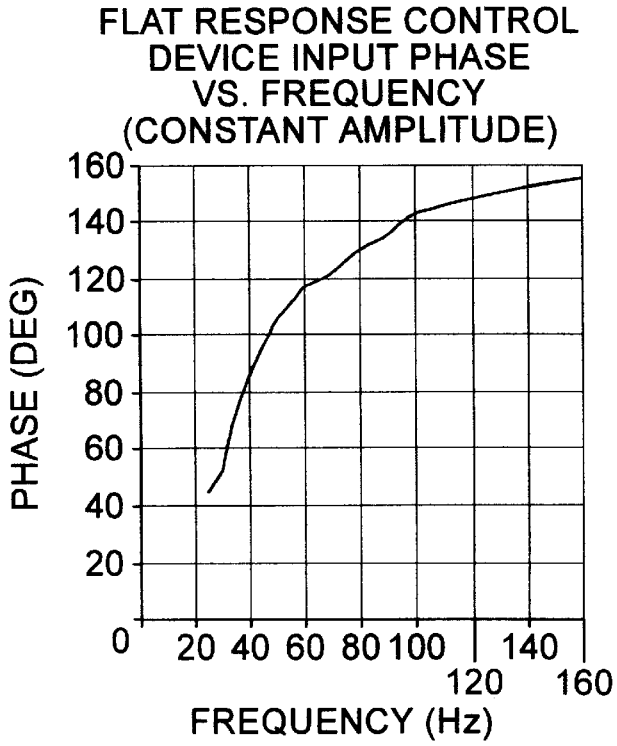
FIG. 7.2

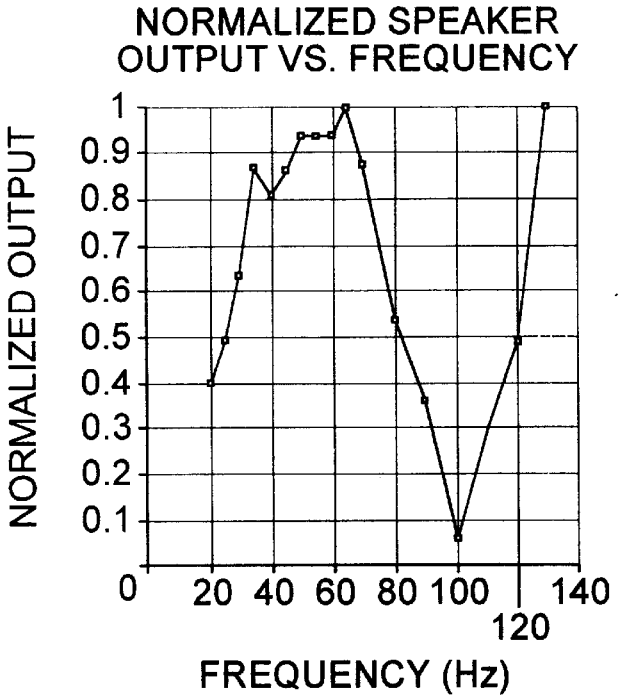
FIG. 7.3
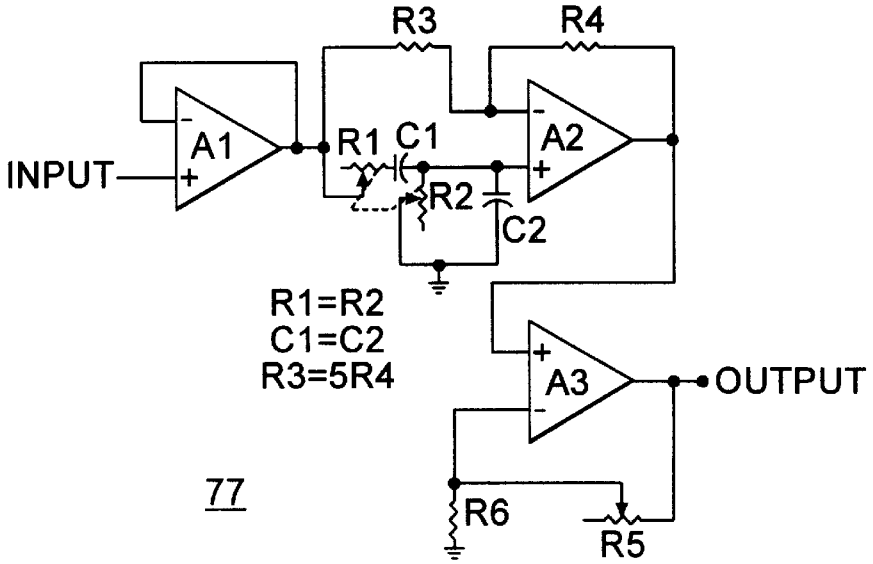
FIG. 7.4

ACTIVELY CONTROL SOUND TRANSDUCER

This is a continuation-in-part of my patent application, U.S. Ser. No. 08/674,436 filed Jul. 2, 1996 now abandoned.

BACKGROUND

Sound transducers convert electrical signals into sound waves. A loudspeaker has one or more output sound transducers supported in a housing. The housing has a front opening for each output transducer. The volume of space behind the output sound transducer is the speaker cavity. Each sound transducer has a diaphragm that vibrates in response to the amplitude and frequency of applied electrical signals. With all passive designs, the shape and the size of the cavity influence the output of transducer. Under normal atmospheric conditions at frequencies above a few hundred hertz even a small cavity can be used to trap and prevent out-of-phase sound waves produced by a speaker, or, in general, any sound transducer, from interfering with the desired waves. But at frequencies below a few hundred hertz, the enclosure volume and resonance effects become significant. At low frequencies the size of the cavity creates pressure effects that alter the transducer's output compared to the ideal enclosure. The pressure effects create sound output amplitude decreases with lower frequency (roll off), distortion with decreasing frequency, and unwanted resonances. Present speaker designs generally rely upon passive acoustic methods to compensate for enclosure effects on the transducer output. Some examples of passive compensation include acoustic suspension, bass reflex, or the use of materials such as fiberglass to increase the effective cavity size. Another design uses the phase effects of several radiating speakers sharing the same enclosure to alter normal passive effects produced by the enclosure. Since accurate and loud base reproduction is hard or impossible to achieve with simple passive designs, the designers use the resonance effects to create a "booming sound" or false base that is not an accurate reproduction but has the sound of loud low sounds.

In a passive design, the inherent qualities of the structure of the design are used to counteract roll off and resonance without expending energy to artificially control cavity characteristics. Examples of such passive designs are:

1. Cavity size can be increased so that roll off is experienced at lower frequencies.
2. The cavity is filled with material, such as fiberglass, to increase the effective acoustical size of the cavity.
3. Special dampening materials can be used to reduce structural vibrations.

Despite efforts of others to passively control the cavity pressure, there remains an unfulfilled need for small speakers that can accurately reproduce sound, especially low frequency sound. There is a need for a speaker that will minimize low frequency distortion. There is also a need for a speaker that will reinforce certain frequencies to provide resonance at one or more desired frequencies. There is a further need for a speaker whose output is adjustable to both null certain frequencies and to reinforce others. There is a need for a speaker that is adjustable so the ranges of the nulled and reinforced frequencies are not fixed, as in passive designs, but are controllable and variable as selected by the user. There is a need to control these properties independent of constraints on the cavity's shape and volume. These and other needs are met by the invention described and claimed below.

Some prior art attempts have sensed the pressure in the cavity behind the output transducer and have used negative feedback to null the pressure in the output cavity. See, for example U.S. Pat. Nos. 5,461,676 and 5,327,304. However, it is difficult to accurately provide a null closed loop feedback system that has acceptable distortion. often the distortion of such systems are unacceptable to listeners. Moreover, such closed loop null systems can require complex control electronics. Even when such systems are used, they are unstable at certain frequencies that cause unwanted oscillations. It has been noted that even when pressure is nulled, the cavity will continue to vibrate. This indicates the need for positive pressure to reduce the spurious vibrations. Such systems cannot be adjusted to provide positive pressures or artificial resonances at arbitrary frequencies and rely only on nulling the pressure in the output cavity.

U.S. Pat. Nos. 5,461,676 and 5,5,327,304 apply to the restricted case of closed loop cases only. The above patents make no reference or implications to any of the other more general cases of active resonances and minimums, open loop designs, static pressures other than equal to outside, other gases, or the infinite cavity. The latter is not in a nulled condition but consist of traveling waves of similar amplitude but 180 degrees out of phase with the output. They also do not infer simulating passive effects such as resonances and minimums, or other active effects not possible with passive designs in the general sense of total arbitrary control of the cavity pressures and their effects on the speaker output. Closed loops, while helpful, are nevertheless restrictive in the amount and types of controls that can be applied to the speaker cavity. The cited patents are limited to nulling cases. However, full control of the cavity would allow the user to selectively increase or decrease the pressure in the speaker cavity as a function of variables other than cavity pressure, e.g. the frequency of the driver signal. Applicant's open loop design provides such flexibility.

The effects of FIGS. 3.2, 3.3 and the example design of FIG. 5.1 are not suggested in the two previous patents. The example design of FIG. 5.1 is totally open loop in operation. The sensors previously shown in the parent application were used only in characterizing the design. None of the data displayed in FIGS. 6 and 7 for the normal operating mode of the speakers are made with a closed loop or nulled cavity. The example design relies on the principles of artificial resonances and minimums only. These effects are in no way mentioned of implied in the previous patents. The circuit of FIG. 7.4 which produces the necessary phase shifts, is part of an open loop system with no sensor input. Setup of the adjustments shown is done once initially using only the sound level at the listener in the specific environment in order to produce the flat or other desired final response. The phase settings are different for different amplifiers and acoustic effects of different listening environments. The data of FIG. 6 was made at single frequencies with the open loop circuit C1, the same circuit used to produce the flat responses of FIGS. 7.1 and 7.3.

The invention reduces or eliminates the "booming sound" due to resonances. That result is in not implied, mentioned, or obvious in the art of record. In contrast, it was determined experimentally. It is not obvious or true that all other active designs other than the example will eliminate the booming sound in all cases and it is definitely not true if the resonance frequency is not specifically driven. The open loop design was initially chosen because a closed loop design must use complex digital electronics to prevent oscillations and instabilities if a good null or other active effects was to be obtained, due to the complex phase and amplitude changes occurring in the active cavity. The closed loop oscillations that occur using an analog circuit could not be filtered out since they are contained within the desired band. In contrast, the open loop designs can be very simple and practical to produce cheaply, as the design shown, C1 which uses a single integrated circuit. In practice C1 is just connected in series with one of the existing subwoofer amplifiers, is adjusted once on setup, and no other wires such as those for sensors being required. The normal dual subwoofers are then replaced with the single active design. The original dual channel subwoofer amplified is used to drive the single active subwoofer.

The U.S. Pat. No. 5,327,504 of Jul. 5, 1994 and U.S. Pat. No. 5,461,676 of Oct. 24, 1995 apply only to speaker with a closed loop null with cavity pressure equal to the outside, i.e. closed loop nulling. The filter method will not work, at least in the example cases of FIGS. 5.1 and 12, because resonances occur within the band of interest 20–100 Hz, so filtering would delete part of the frequency band. In addition analog closed loop instabilities cover a wide range of frequencies so a filter would have to delete at least a third of the band. The mechanical resonances of the active cavity are more complex than its electrical counterpart because both the phases and amplitudes needed for resonance vary depending on cavity pressure conditions. So even if the phase is artificially shifted at one resonance to cancel it, the cavity always seems to find a new resonance if using sufficient gain to close the loop. Even if a stable region could be found in the control loop, complex music with its widely varying amplitude and frequencies could drive an apparently stable circuit into temporary oscillations when conditions sometime force the control loop into a region of instability.

In normal practice the nulled cavity would not be used much, but more likely some combination of maximums and minimums, with possibly a few specific frequencies only using the nulled cavity. The closed loop null cavity is not as practical as the non nulled and open lop case because:

1. It does not produce the usual desired response, which is flat from 20 Hz to some higher value in the 100 to several hundred Hz range.
2. It is not practical to implement using simple analog electronics over the normal frequency ranges desired.
3. Complex digital electronics are needed to produce a total cavity null over all frequencies normally of interest, making the circuits expensive unless produced in very large numbers. Even if digital was implemented it would most likely be used to produce other effects in addition to the simple null.
4. The simple cavity null does not produce the lowest distortion at all frequencies depending on the speakers used. A positive force on the speaker cone, especially at the lower frequencies, about 25 Hz and less, helps prevent oscillations of the speaker cone material. At very low frequencies oscillation modes can be excited on the cone material itself due to the lack of pressure due to the low speed of the cone. These will emit directly into the outside appearing as distortion. This can even happen at higher frequencies which is one of the reasons the cavity may often be run with carefully controlled pressures that do not interfere with the desired output.
5. Some speakers become mechanically offset at high continuous powers, which can be corrected for with a static pressure different than the outside pressure.

SUMMARY OF THE INVENTION

The invention provides an actively controlled sound transducer cavity and a method for actively controlling the sound energy in the cavity and, in particular, controlling changes in pressure in the cavity. A speaker having an open loop, nonnull closed loop or a combination of open and closed loop controls for controlling the pressure in the cavity. In particular, the controls use the output driver signal as modified by one or more controls for changing the phase, amplitude or frequency, including one or more harmonics of the driver signal. The invention allows the user to select ranges of frequencies for nulling and for reinforcing, and controlling the distortion effects of passive cavities. The speaker comprises an enclosure with one or more apertures. In each aperture is as output sound transducer, typically a diaphragm, which radiates output sound into the ambient space in front of the loudspeaker. When the diaphragm radiates output sound, it also produces spurious sound waves in the cavity. The spurious sound waves alter the pressure in the cavity.

One or more control means are mounted in the cavity to actively control the pressure in the speaker cavity. The actively controlled cavity is independent of the size and shape of the cavity. In one embodiment the control means are cavity pressure control devices (CPCDs). The CPCDs are mounted in the cavity and sound waves or pressure in the cavity that can null or reinforce a spurious sound wave or pressure changes produced by the output diaphragm, or produce other desired pressure effects. So, the cavity pressure control devices are also sound transducers, or other devices for altering pressure in the cavity.

The control means may be driven by an open or closed loop device. In the open loop configuration power is applied to the CPCD in a predetermined manner depending on the input signal. In the closed loop configuration the power applied to the CPCD depends on the pressure in the cavity. A hybrid configuration uses a combination of open and closed loop to drive the CPCD.

For a closed loop configuration the control means may includes one or more sensors. The sensors detect the effects of instantaneous changes in pressure in the cavity produced by spurious sound waves. The sensors are mounted in the cavity and they sense characteristics of the spurious sound waves including phase, frequency, and amplitude. A typical sensor is a microphone. The sensors are coupled to a control device (CD). The CD generates a control signal that operates the CPCD.

For an open loop system the CPCD is driven in a predetermined fashion with a phase, frequency, and amplitude to produce the desired transducer output effects, independent of the actual pressure in the cavity. The open loop configuration does not depend on a cavity sensor for operation. In the open loop mode the CPCD will usually be driven with a phase, amplitude and frequency that is related to the transducer input signal, although it may also be independent of the input signal depending on the desired effect.

For a hybrid closed/ open loop system the power to the CPCD is both predetermined and to some extent related to the cavity pressure. This configuration is more practical for very precise cavity control since a closed loop system can fine tune the pressure after most of the pressure alteration is completed by the open loop system.

For both open and closed loop systems the phase, amplitude and frequency of spurious cavity sound waves are important characteristics. For closed loop sensing the phase, amplitude, and the frequency of the cavity sound waves, the CPCD can be driven with the correct phase, amplitude, and the frequency so as to produce the desired cavity pressure. The CD may or may not use the same driver signal applied to the output transducer to drive the CPCD. In general by phase shifting the driver signal and altering its amplitude, the unwanted frequencies of the spurious sound waves may be mostly nulled, increased, or decreased. The CPCD driver signal has to be phase shifted and amplified before it is applied to the CPCD. To obtain a good null or low distortion transducer output harmonics usually have to be added to the CPCD driver signal, also with the correct phase and amplitude. A closed loop system will automatically generate the correct signals, where as in an open loop system these are predetermined.

This invention actively alters the cavity pressure to artificially produce arbitrary cavity waves or pressure effects. Thus any passive design may be artificially simulated to the extent allowed by the designs and components used. In addition, other effects may be produced that are not generally practical using passive techniques. For instance, resonances at specific frequencies or ranges of frequencies, minimums, the simulation of the ideal enclosure or nulled cavity and most importantly the flat/ low distortion response.

In the active control design of the invention, work is performed in a controlled manner to accomplish a desired function. Examples of this, within the scope of the invention, are the following: (1) one or more cavity transducers are used to null the pressure in a speaker enclosure, producing a lower roll off frequency, less distortion, and absences of resonances; (2) one or more cavity transducers are used in order to control the pressure in a small speaker enclosure producing the effect of a much larger or ideal enclosure size; (3) one or more cavity transducers are used in order to produce a response that is flat with low distortion from 10 to 100 Hz in a small speaker enclosure. So, the invention provides a speaker of relatively small dimensions or arbitrary shape that faithfully reproduces sound at the lower ranges of human perception.

BRIEF DESCRIPTION OF THE DRAWING

FIGS. 2.01, 2.02, and 2.1–2.4 show how pressure varies over time in an ideal speaker (FIG. 2.01) and in the speaker of FIG. 1*a*.

FIGS. 3.01*a*, 3.01*b* compare the output and cavity of a speaker without the invention up to about 100 Hz;

FIGS. 3.1*a*, 3.1*b*, 3.2*a*, 3.2*b*, 3.3*a*, and 3.3*b* compare the output of speaker 20 with the speaker cavity 28 for frequencies up to about 100 Hz;

FIGS. 4.1, 4.2, and 4.3 are alternative embodiments of the invention;

FIG. 5.1 is a working example of the invention;

FIGS. 5.2*a* and 5.2*b* are graphs showing passive characteristics of the speaker of FIG. 5.1.

FIGS. 6.1–6.4 are graphs showing results of tests performed on the speaker of FIG. 5.1;

FIGS. 7.1–7.3 are graphs of further tests performed on the speaker of FIG. 5.1.

FIG. 7.4 is a detailed schematic of the control circuit in FIG. 5.1;

DETAILED DESCRIPTION

Figure 1A:
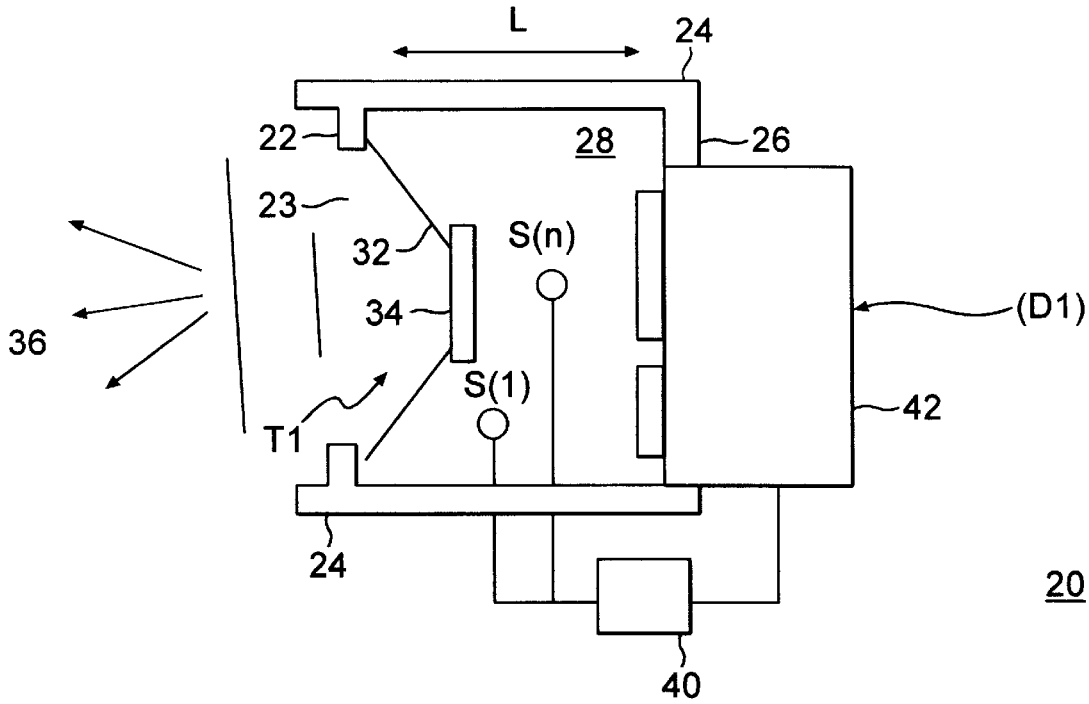
FIG. 1*a* is sectional schematic view of one embodiment of a speaker with the invention.

FIG. 1*a* depicts an example structure of a speaker 20 made in accordance with the invention. The speaker 20 has a front wall 22 with an aperture 23. Side walls 24 and rear wall 26 enclose the cavity 28. An output transducer T1 has a diaphragm 32 mounted proximate the front wall 22 in the aperture 23. For illustrative purposes, only output transducer T1 is shown. Those skilled in the art know that the speaker 20 may have two or more transducers, i.e., several woofers (low frequency), and one or more tweeters (high frequency) and mid-range transducers. A voice coil 34 drives the diaphragm 32 as indicated by arrow 36. Those skilled in the art understand that other drive means may operate the diaphragm. For example, an electrostatic driver could replace the voice coil 34. Output transducer T1 radiates energy in the form of sound pressure into the atmosphere, gas, or some other acoustic fluid medium. The cavity 28 has a length L. Cavity 28 has a first cavity pressure control device D1 on the rear wall 26. Pressure sensors S1, S2, through S(n) in cavity 28 are connected to a control circuit to D1.

The cavity 28 traps out-of-phase waves in order to prevent them from interfering with the output. D1 controls pressure in the cavity 28 so as to simulate any desired passive cavity design or create novel pressure effects. D1 can be used to generate either a dynamic or static pressure in the cavity. The number of sensors used depends on the specific design and effects desired. The control circuit 40 determines what signals are used to control D1. The sensors S(1), S(2) . . . S(n) are optional and the invention may be practiced with or without sensors (open loop configuration).

The cavity 28 may be completely or partially sealed, but is sufficiently closed to allow the pressure in the cavity 28 to be regulated. D1, which is disposed inside the cavity 28, can be considered a separate unit whose only purpose is to control wave or pressure effects in the cavity 28. D1 is not intended to be a radiator to the surrounding atmosphere. However, in practical designs, some energy, however small, will inadvertently be lost to the surroundings. D1 may be of any suitable design such that energy is applied to D1 to accomplish work in such a way that D1 drives the gas or other fluid in the cavity to actively alter the changes in pressure in the cavity. The physical construction of the control circuit 40, if one is used, may or may not be of electronic, analog, or digital construction. The effects of T1 output 36 feeding back into T1 will be ignored in the discussions of this invention.

Figure 1B:
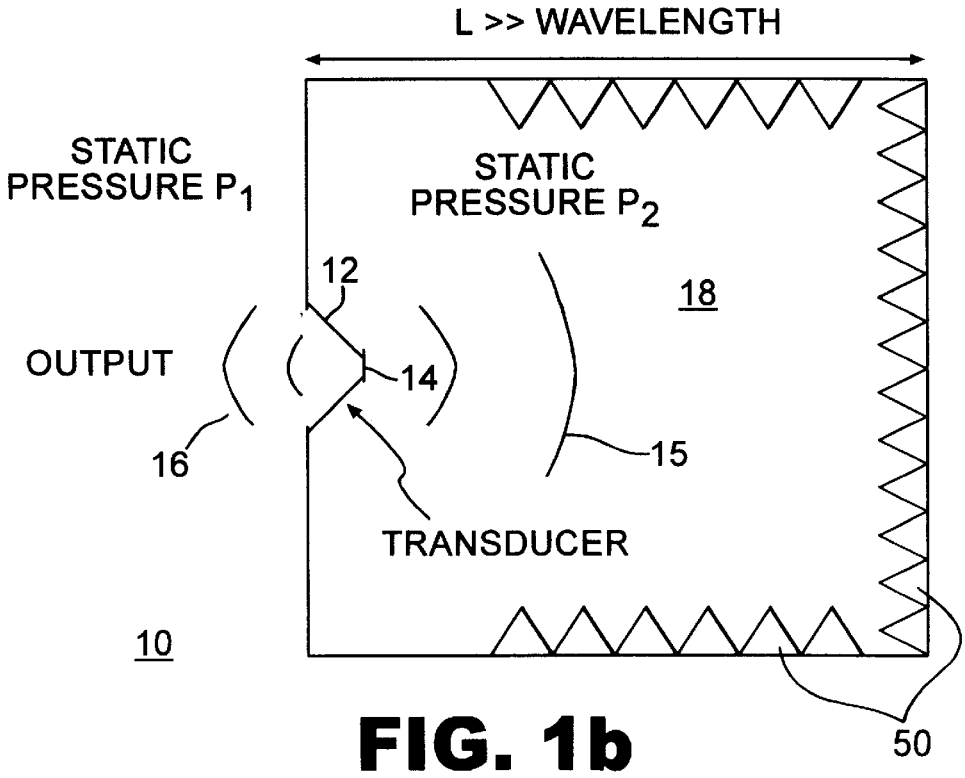
FIG. 1*b* is sectional schematic view of an ideal passive speaker based on prior art.

FIG. 1*b* shows an ideal cavity. The output transducer comprising diaphragm 12 and voice coil 14 is embedded in a very large enclosure or one that does not let out-of-phase waves return to interfere with the output. The ideal cavity 18 has no amplitude resonances at specific frequencies, no amplitude roll offs with decreasing frequency due to pressure increases, or other frequency dependent effects found in practical designs. So, the length of the ideal cavity L is much greater than wavelengths of the acoustic output desired. To prevent distortion at frequencies as low as 20 Hz, the ideal cavity will be longer than the wavelength (about 55 feet) under normal conditions. Sound absorbent material 50 covers the inner surface of the cavity 18. The ideal cavity contains of traveling waves and is not to be confused with the nulled cavity in which only static pressures exist.

The outside static pressure, $P_1$, and inside static pressure $P_2$, are nearly the same. Otherwise a net constant force would cause distortion, prevent operation, or damage the transducer. Ideally, if pressure $P_2$ were zero, meaning a vacuum condition, then no energy would be dissipated into the cavity, and all energy could be used to drive the output. In addition, there could be no cavity generated effects because the cavity effectively doesn't exist, and cavity size is irrelevant. However, providing a vacuum in the cavity 18 or 28 is impractical. Even if the paper diaphragms 12 and 32 could survive the massive force of the air pressure, the voice coils 14, 34 would have to be massive in size to exert enough force to move the diaphragms against the outside air pressure. However, it has been discovered that the vacuum can be approximated by controlling the changes in dynamic pressure inside the cavity 28. The invention uses D1 with an open loop controller to cancel the pressure variations produced by T1, or "nulling" the pressure changes. Such nulling produces an effect similar to the ideal cavity with $P_2$ close to zero.

FIGS. 2.01, 2.02, 2.1, 2.2, 2.3, and 2.4 show how the pressure in the cavity varies versus time for four important examples of the structure in FIG. 1*a*. In order to display relative phases of the pressure variations with respect to time, the six graphs are intended to be viewed as aligned vertically, with identical origins and time scales, in order to display relative phases of the pressure variations with respect to time. In reality the pressure will not be exactly constant throughout the cavity due to finite wave speed, temperature differences, and presence of higher harmonics. Also the basic characteristics shown are only the approximate overall general properties encountered in cavities, since more accurate representations of pressure will depend on specific designs and transducer properties. See FIGS. 5.2 through 7.3 for some actual characteristics. The waves are shown as an example and need not, and for the real case will not, be sine waves or be symmetrical around the static pressure.

FIG. 2.01 shows the cavity pressure produced by the transducer in the ideal passive enclosure of FIG. 1*b*. There the cavity pressure versus time for this example is a sine wave 52. The motion of the of the transducer that creates this cavity pressure sine wave will also be a sine wave 52, but shifted in phase by 180 degrees. The pressure in the cavity 18 is normalized at ±1 for purposes of explanation.

In FIG. 2.02 the corresponding cavity size L of a normal, non-ideal passive speaker is defined to be much less than the wavelength of wave 52. This is typical of real world speakers. FIG. 2.02 is the case of the normal passive enclosure without the invention. Note that in 2.02 the peak amplitude of the cavity pressure is N, where N>1. This increase in amplitude is due to the limited cavity size L. In other words, as the output transducer T1 generates sound, it also generates a greater pressure throughout cavity 18. The pressure in cavity 18 can equal or exceed the outside pressure $P_1$. As a result, there is a back pressure on the diaphragm 12 that interferes with its motion. When the motion of diaphragm 12 is altered, the listener hears a distortion in the sound from the speaker 10.

FIGS. 2.1–2.4 refer to the speaker of FIG. 1*a*. Again, the length L is much less than the wavelength of the sine wave 52. FIG. 2.1 shows how a pressure null may be produced in the cavity. Cavity pressure control device D1 drives the cavity with a phase and amplitude so that changes in cavity pressure $P_2$ are dynamically zero, or effectively at a constant static pressure at all times. This condition, the nulled cavity, represents the least resistance to T1. In other words, T1 experiences very little force due to changing pressure in the cavity, and the dynamic force on the speaker in this case is mostly due to that required to produce an output into the atmosphere. Thus, there would be no low frequency roll off in output amplitude or distortion due to changing cavity pressure with greater speaker excursions. This will be discussed in more detail later.

FIG. 2.2 shows how D1 can simulate the ideal cavity. D1 changes the pressure in the cavity to equal the amplitude and the phase of the ideal passive enclosure pressure shown in FIG. 2.01. As a result, the output of T1 will be the same as the ideal cavity.

FIG. 2.3 shows how to produce an effective resonance at that frequency. D1 produces a cavity pressure in phase with the motion of T1, but 180 degrees out of phase with the normal pressure in the passive enclosure 2.02, so as to assist the motion of T1. D1 drives the cavity and produces a pressure opposite in magnitude at any given time to the ideal pressure shown in FIG. 2.0. This produces a greater output from T1 similar to a resonance. In practice, it can produce an output from T1 several times greater than the passive cavity.

In FIG. 2.4, D1 produces a cavity pressure 180 degrees out of phase with the motion of T1, but in phase with the normal pressure in the passive enclosure 2.02, and with appropriate amplitude, so as to cancel the motion of T1. This produces very little output from T1. The output amplitude will depend on the amplitude of D1, which is any arbitrary value n in this example. This allows the speaker 28 to generate excellent minimums. T1 can even be made to move in reverse phase in step with the pressure from D1.

FIGS. 3.01*a*, 3.01*b* compare the output and cavity of a speaker without the invention up to about 100 Hz. FIGS. 3.1*a*, 3.1*b*, 3.2*a*, 3.2*b*, 3.3*a*, and 3.3*b* compare the output of speaker 20 with the active speaker cavity 28 for frequencies up to about 100 Hz. In those figures the transducer acoustic output and cavity pressure vary as a function of frequency for several important examples. The scales on all graphs are logarithmic, with vertical scales normalized to demonstrate the general effects described. Time averaged dynamic cavity pressure is shown so that frequency effects can be plotted.

FIGS. 3.01*a* and 3.01*b* are reference figures that represent effects found in a normal passive cavity where wavelength is much less than cavity size L. The frequency range of 10 to 100 Hz represents a practical case of interest. As expected, the output of the speaker falls as frequency decreases. The fall in output is matched by a corresponding increase in the cavity pressure. The fall off in output at low frequencies is caused by the increase in dynamic pressure in the cavity. The higher dynamic pressure $P_2$ in the cavity interferes with the movement of the diaphragm and thereby restricts the output. At low frequencies, the dynamic pressure is relatively high because the sound waves in the cavity have a wavelength longer than the cavity and so they build up pressure in the cavity due to the greater diaphragm displacements at these frequencies. As frequency increases, the transducer displacement is less for the same sound output and the changes in pressure in the cavity are less. FIG. 3.01*a* shows the roll off at lower frequencies in the passive cavity. FIG. 3.01*b* shows how the cavity pressure increases with lower frequencies when power is increased to sound transducer to maintain a constant output in a passive cavity.

When the invention is applied to a speaker as in FIG. 1*a*, the output and the cavity pressures are substantially different compared to the prior art passive results. FIG. 3.1*b* shows how D1 drives the cavity 28 with a phase and amplitude so that changes in the cavity pressure $P_2$ are nulled to be dynamically zero over all frequencies. The result of nulling produces an output response free of the effects of increased pressure, similar to a vacuum in the cavity. FIG. 3.1*a* shows the output result and how the invention produces output from T1 that is free of the normal passive cavity roll off shown in 3.01*a* assuming the transducer radiates a constant output for the same power. FIG. 3.1*a* uses the flat response as an idea case for reference, even though in most practical cases the actual output nulled will not be flat due to the size of the transducer and its radiating and resonance characteristics. One of the most important benefits of the nulled cavity is reduced distortion at many frequencies that results from the lack of increasing pressure as the diaphragm amplitude increases. Experience shows that at very low frequencies and certain others depending on the actual transducer, lower distortion will be obtained by running the cavity with a simulated resonance or under normal cavity pressure due to complex vibrations in the transducer materials. This is one reason why under real conditions the cavity will rarely be used in the nulled state at all frequencies.

FIG. 3.2*a* represents the simulated ideal cavity with output amplitude normalized to "1" over all frequencies. FIG. 3.2*b* shows the cavity pressure $P_2$ is driven to be equal to that of the passive ideal cavity of FIG. 1*b*. This is the general case of FIG. 2.2 where the output at all frequencies will be the same as the passive ideal cavity, but produced artificially using the principles of the actively controlled enclosure shown in FIG. 1*a*. In effect, the transducer D1 is driven to keep the pressure in cavity 28 the same as the ideal cavity. This can be accomplished, as will be explained hereinafter, by operating the pressure transducer D1 to correct for the pressure changes due to the spurious sound waves.

One feature of the invention is its ability to null some frequencies and to reinforce others in the output of T1. That feature is illustrated in FIGS. 3.3*a,* 3.3*b,* where D1 changes the pressure in or out of phase so as to assist or hinder the motion of T1. This produces the greater output characteristic of the standing waves at or near a resonance, or a minimum where pressure is out of phase. FIG. 3.3*b* shows the pressure in the cavity that will be generated by D1 to produce the output effects of FIG. 3.1*a*. The artificial resonances and minimums can be at a number of single frequencies or over a frequency band. Resonance amplitudes can be made greater than the nulled cavity, FIG. 3.1*a*. So, with the invention, the user can select which frequencies to null and which to reinforce. This provides a combined filter and amplifier for selected frequencies that filters and amplifies frequencies by controlling the changes in the pressure in the cavity 28.

FIGS. 4.1–4.3 show some of the possible configurations that can be made to control a cavity pressure transducer D1 and how two or more cavity pressure transducers can be used, depending on the pressure effects required in the cavity. FIG. 4.1 shows a way to control the system by using closed loop control. A drive signal drives the output transducer T1. The input of the control circuit 48 is received from the sensors. Control circuit 48 generates a control signal that drives pressure transducers 42 and 44.

Those skilled in the art will understand that the amplifier 48 and closed loop described above may be implemented with digital or analog electronics, although it may be hard or impractical to perform in analog due to oscillations, especially when working over the 20 to 100 Hz band where the resonances occur within band and cannot be filtered out. So, the control circuit 48 may be a digital signal processor that samples in real time the outputs of the sensors and adjusts the control signal to the transducers 42, 44 to achieve the desired results in changes in the cavity pressure.

FIG. 4.2 shows a way to control the system by using open loop control. The T1 drive circuit 46 passes a portion of the T1 drive signal 41 on to the open loop control circuit 47. The open loop control circuit 47 may include a digital signal processor and suitable memory for holding data and programs specific to the construction and operation of the speaker. The memory, for example, may hold data about the size of the cavity 28, the inertia of the speaker, and the dynamic performance of the output transducer T1, or experimental tests of the cavity characteristics. It is programmable by the user to null certain frequencies and reinforce other frequencies. For a given drive signal 41, the control circuit 47 can automatically achieve the desired programmed results of nulling, resonance, or other desired effects. While the foregoing description relies upon digital electronics, those skilled in the art will know that control circuit 47 can be implemented with analog circuits that can achieve substantially the same results as the digital electronics for simple cases such as the flat response.

The embodiment of the invention shown in FIG. 4.3 controls pressure in cavity 28 using a combination of open loop and closed loop controls. Sensors measure cavity pressure at one or a number of locations in the cavity 28. Output transducer motion could be measured in lieu of or in addition to cavity pressure as a method of determining cavity control device output. The drive signal 41 is connected to divider circuit 46 and a portion of the drive signal is passed to control circuit 47. Amplifier 48 receives inputs from the sensors. The output of the amplifier 48 is coupled to the control circuit 47. The control circuit 46 and 47 comprises digital, analog, or a combination of digital and analog elements and circuitry. It may be selectively operable in an open loop mode, a closed loop mode, or in a combination of open and closed loop operation. For example, the closed loop may operate when sensors detect low frequencies, i.e., below 100 Hz, and the open loop may operate on frequencies above 100 Hz, or open loop may cover all frequencies with closed loop over the non-resonant potions when using analog circuitry.

The examples of FIG. 4 are not intended to limit the type of cavity pressure control device or devices. The following changes, additions, modifications and substitutions are deemed within the scope of the invention: sealing the cavity from fluid leaks to the ambient atmosphere including the amount the cavity is sealed, filled or baffled; applying a static pressure to the fluid in the cavity 28 not equal to the outside pressure and/or filling the cavity 28 with a gas composition different from air; varying the number of control loop sensors and their locations selected to by empirical methods to achieve desired control of the pressure changes in the cavity 28; or varying the number of pressure control devices and their layout in the cavity to achieve the desired cavity pressure control. The control device drive signal may be any suitable means such as an electronic or a pneumatic signal, which is determined, powered, and controlled. For example, the invention contemplates pressure signal lines replacing the sensor and drive signal lines. The pressure signal lines may be coupled to a pneumatic or a combined electro-pneumatic system that controls the pressure changes in the cavity 28. The rear wall of the cavity may have a control valve selectively connected to a powered source of pressure and an exhaust. To reduce dynamic increases in pressure, the valve opens to the exhaust cavity. Likewise pressure could be applied to reinforce desired frequencies. The active control may be combined with any type of passive design, such as those that allow pressure to escape the cavity, or by the design of the cavity shape and baffling.

Another previously patented method of correcting for cavity pressure effects is to sense the final output and using a closed loop system to apply the necessary drive signal to produce the original desired output. While this may seen to eliminate the need for using cavity control it has additional problems which tend to make it less practical when used alone. It needs fairly complex electronics to implement the control loop. In addition the large pressures at the very low frequencies means there is a very large force on the output speaker. The large forces can distort the speaker cone and cause oscillations on the cone material resulting in emitted distortion that cannot be compensated for in the control loop. This method is best used at low frequencies in combination with a controlled cavity.

The transducers driving the cavity are subject to some of the same problems the original speaker encounters, but they effectively to solve part of the problems, not all of them at once. Consider the method of controlling cavity pressure as solving a total problem in a series of steps. Trying to compensate for all the cavity induced problems with a single transducer is similar to trying to build a high quality amplifier with a gain of a million using a single transistor. Normally a number of stages are used with more practical gains of 10 to 100. So trying to compensate for all cavity problems with a single transducer is the same. Large pressure problems in a cavity have to be compensated for in several stages similar to a high gain circuit. The smaller the cavity, and greater the pressure problems, the more stages, or in this case individual transducers, are needed. In some cases D1 may have to consist of a number of transducers in parallel and series to control the cavity enough so that the output transducer, whether controlled or not, can do its job.

FIG. 5.1 shows a further example of an active enclosure 70, that is particularly adapted to act as a subwoofer for use in the 30 to 100 hertz range. The speaker 70 is constructed economically out of easily obtained parts, uses simple analog circuitry with a small number of components, is a practical size to be used in occupied spaces, and represents one of the simplest examples of a driven cavity. It is based on an eight inch diameter speaker output diaphragm 72 that is driven by a voice coil 73. A cavity pressure transducer D1 comprises diaphragm 80 and voice coil 79 is mounted behind and aligned with the speaker diaphragm 72. This design is based on the open loop control method of FIG. 4.1. The input to circuit 77 is a signal representative of the drive signal to the voice coil 73. The circuit 77 is adapted to modify the drive signal in a predetermined way in accordance with the amplitude, phase and frequency to provide a controlled drive signal to the voice coil 79. The control circuit 77 has suitable adjustment means for altering the phase and amplitude of the input drive signal. These controls include variable resistors R1 and R2. Control circuit 77 produces an output controlled drive signal having the desired minimizing and reinforcing of selected frequencies when the output is limited to normal listening levels in the low frequency range from 100 Hz down to about 30 Hz. The purpose is to have a flat response in the 30 to 100 Hz range, have acceptable distortion, be inexpensive, and be contained in a small box. The advantage is that there are no low frequency amplitude roll off, low frequency distortion, and annoying resonances typical of small enclosures due to pressure effects.

The small box has the same, and in some ways better, low frequency sound at low volumes than a very large enclosure, yet is practical to carry around and not take up a significant amount of space. The cavity 76 was made as small as possible by placing the cavity diaphragm 80 as close as possible to the speaker diaphragm 72 and filling the space between the two with sound absorbent foam 78. In addition to reducing the volume of air in the cavity 76 that must be compressed, the foam absorbs some of the higher harmonics produced by D1, therefore reducing unwanted sound radiating out of the cavity.

The circuit that drives the example enclosure consists of two power amplifiers 88, 89 driven by the same signal, except that the phase and amplitude of the signal driving the amplifier 89 (the one connected to cavity voice coil 79) is adjustable by circuit 77. Circuit 77 includes a constant amplitude phase shifter followed by a variable gain circuit. The phase shift varies with frequency but can be adjusted positive or negative almost 180 degrees at any one frequency. Circuit 77 is implemented with a single quad operational amplifier integrated circuit and is completely adjustable with two variable resistors. This circuit is adjusted once to the desired frequency response on initial setup of the speaker mainly to account for phase and gain differences in amplifiers 88 and 89, and to a smaller extent environment acoustics. After initial setup the system is run open loop and only needs to be checked if one of the components is changed.

FIGS. 5.2 through 7 show test results of the characteristics of speaker 70 that correspond to the characteristics explained in connection with FIGS. 2.01, 2.02, and 2.1–2.2 and FIGS. 3.01*a*, 3.01*b*, 3.1*a*, 3.1*b*, 3.3*a*, and 3.3*b*. The data representative of 3.1*a* and 3.1*b* are for reference and demonstrate the quality of the system and its ability to control the cavity 76 environment. Checking the nulling ability of the system was found to be useful to test the quality of active cavity system after initial construction, modification, or repair. The system is actually operated using the principles shown in FIGS. 3.3*a* and 3.3*b*, using the effects of artificial resonances and minimums. Actual results for two different conditions are shown in FIGS. 7.1 and 7.3.

FIG. 5.2 shows some of the enclosure characteristics with D1 disabled. As shown in FIG. 5.2*a*, the speaker displacement (the travel of the diaphragm 72) increases as the frequency decreases for constant power to the speaker. The small enclosure leads to increased cavity pressure with lower frequency. See FIG. 5.2*b*. For room pressure air inside the enclosure, the half wavelength ranges from about 28 feet at 20 hertz to 5.6 feet at 100 hertz. Since the cavity is only about 1% to 5% of the half wavelength one can approximate this as compression of the gas in the cavity in the static case, rather than traveling or standing waves. This makes it easy to measure the pressure since it is almost constant throughout the cavity at any one time.

For this example, at low output, harmonics inside the cavity at null were generally 1/50th or less of the case where D1 is disabled. Therefore the harmonics are not radiated to the outside in significant amounts. Harmonics in the cavity increased significantly at 30 Hz or less, as would be expected for this design. For high output amplitudes at less than 40 Hz, harmonics greatly increase.

In this example D1 consisted of a single diaphragm 80 and voice coil 79 in its own sealed cavity 90. FIG. 6.1 shows the phase and amplitude (as referenced to the signal driving the speaker) of the power that must be applied to D1 to obtain a null. In this case phase varied from 14 degrees at 110 Hz and above, to 43 degrees at 20–30 Hz. Note that it took four times as much power ($A_2$) to D1 than to the speaker 72/73 ($A_1$) to produce a null at 20 Hz, but only 0.7 times as much power to null at 130 Hz. An improved version could use an additional driver or more complex electronics to use pressure to cancel higher harmonics in the cavity so they could not escape through the speaker material and cavity walls into the atmosphere. The 2nd harmonic is usually present after nulling the fundamental. Therefore most sound in the cavity could be nulled if the 2nd harmonic was provided at the correct phase and amplitude as the fundamental is above.

FIG. 6.2 shows an improvement in low frequency sound output amplitude/speaker displacement of the nulled cavity over that of the passive cavity. The speaker excursions are about two times greater when nulled at 20 Hz, but about equal at 150 Hz. Thus FIG. 6.2 shows the expected trend that in the passive cavity speaker excursions are greatly reduced as the frequency decreases. This indicates that the sine waves in a passive cavity are "smashed" by a factor of 2/3 at 40 Hz. From this chart it is apparent that one reason the distortion in a passive cavity increases with lower frequencies is that the normal excursions are compressed, with the amount of reduction increasing with the excursion amplitude. Note that this is the reason power cannot simply be increased to the speaker, while retaining the same waveshape, to produced the same output at low frequencies as the nulled case. If power were simply increased to compensate for roll off then the speaker's output would consist of "smashed" sine waves thereby creating so many directly radiated harmonics that distortion would be intolerable.

FIG. 6.3 shows that nulling the cavity also reduces distortion in the speaker output. As expected nulling the cavity had no effects at higher frequency, but was dramatic as frequency is lowered. Total system sound output distortion was only about 1% higher than input distortion between 40 and 60 Hz. Note that between 20 and 60 Hz the motion of the speaker had almost no measurable increase in distortion when nulled. The motion of the speaker when nulled always had less distortion than nonnulled except at 10 Hz. Because the 8" speaker is more effective at radiating higher frequencies and people can hear the higher harmonics much easier, FIG. 6.3 shows that the radiated sound distortion appears significantly greater that the actual distortion in the speakers motion. Even very small amounts of harmonics in speaker motion appear as a much higher radiated and perceived distortion. Because the sensitivity of the ear increases so quickly above 20 Hz, even a few percent radiated distortion at 20 or 30 Hz is perceived as 50 to 100% or more distortion.

FIG. 6.4 shows the effects of leaks resulting in unwanted sound from D1 for the case of the nulled cavity. The leaks were created by opening holes in the rear wall of the cavity. As the number of holes increased, the total area of the leaks increased. As the total area of the leaks increase the sound output from the leaks rapidly increases until it is equal to the speaker output. At that point further increase in the leaks will reduce the speaker output and the leaking sound will become greater than the speaker sound (back and front sound are isolated from each other in these measurements.) If the sound from the leaks and speaker output were in the same room they will interfere since they are out of phase and thus defeat, to some extent, the reason for the enclosure. Experience shows the driven cavity phases and power ratios curves are simplest, and so easier to control, when the cavity is well sealed. So, unlike certain prior art suggestions, it is not desirable to provide leaks in the cavities. See, for example, U.S. Pat. No. 2,993,091.

FIGS. 7.1 and 7.3 respectfully show examples of an artificially produced flat response and a minimum. Both responses in FIGS. 7.1 and 7.3 were produced with the same open loop analog circuit 77 of FIG. 5.1, but with the two variable resistors at different settings. Good control of the transducer 36 is demonstrated by the ability to so easily make dramatically different responses in the output of the speaker. For both FIGS. 7.1 and 7.3 the amplitude of the signal to the speaker is constant with frequency with only the phase versus frequency curve being changed.

FIGS. 7.1 and 7.3 are examples of the effect in FIGS. 3.3*a* and 3.3*b*, the ability to produce an output response with both resonances and minimums. In FIG. 7.1 the circuit 77 was adjusted for a reasonably flat response from 30 to 100 Hz as compared to the undriven (passive) case. The phase in the case of FIG. 7.1 the phase is shifted continuously in circuit 77 to produce an output 36 that almost exactly compensates for the rolloff of the passive state. FIG. 7.2 shows the phase vs. frequency curve used to produce the flat response of FIG. 7.1 with the amplitude remaining constant.

One disadvantage of not carefully driving D1 with the correct waveshape in other than the nulled case is increased distortion. Driving the cavity to produce the flat response with the same waveshape as the speaker can cause the output sine waves to be increased or decreased non-linearly. Producing the correct waveform needed to reduce distortion is complex, since if it is not done correctly not only will distortion remain, but experience shows additional harmonics will be generated resulting in increased output distortion. Therefore we see that D1 must produce pressure in the cavity with the correct amplitude, phase and waveshape. A non-sine waveshape is equivalent to the fundamental with the addition of harmonics. Therefore adding harmonics to the fundamental with the correct amplitude and phase can be used to prevent increased distortion in the non-null case, FIGS. 3.2 and 3.3, of the driven cavity. Note that this implies that driving the cavity with harmonics alone can reduce distortion, but cannot produce artificial resonances and minimums such as needed to prevent rolloff, or allow the creation of cavity nulls.

Figure 12:
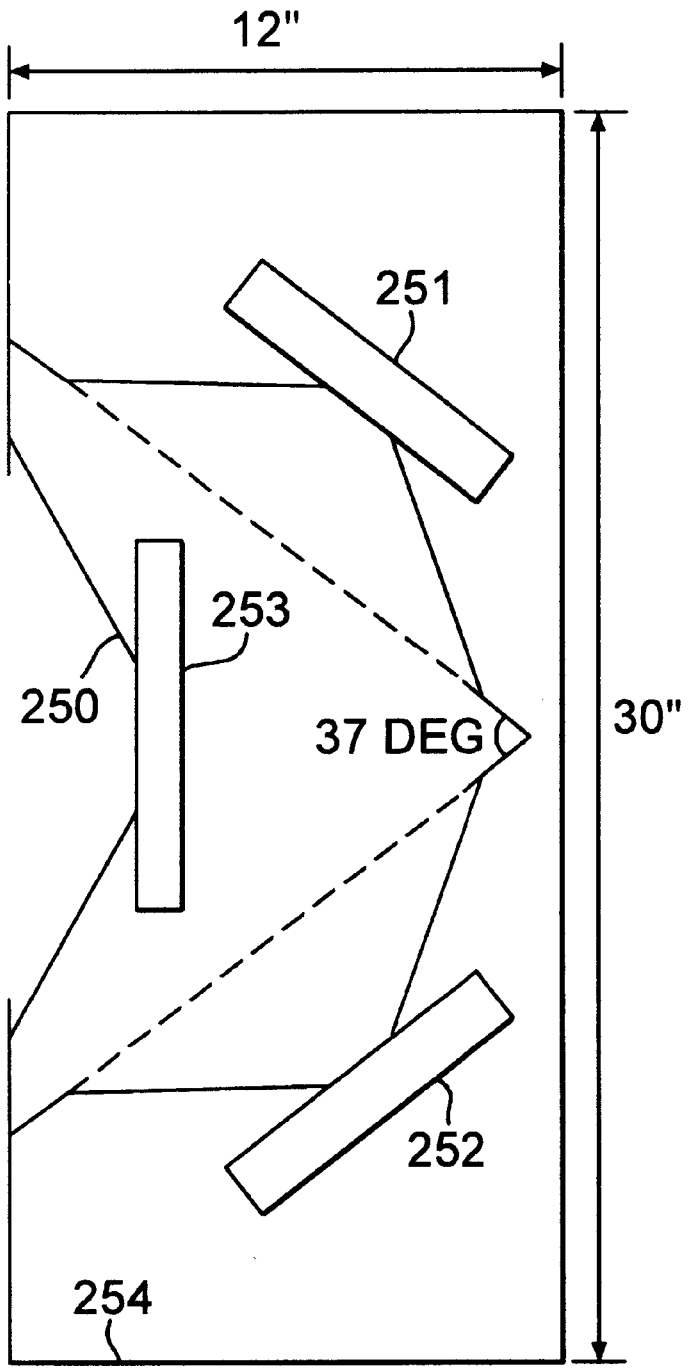
FIG. 12 is a second working example of the invention.

The open loop control method was purposely chosen in this design for its simplicity. A simple analog closed-loop control circuit produces oscillations in the 70 to 90 Hz range that could not be prevented by simple filtering since they are in the desired frequency band. This open-loop version of the driven cavity is one of the simplest and cheapest designs that actually produces excellent sound at normal listening levels. This design allows clear reproduction of some the lowest sounds in classical music such as the bass drum, at normal volumes (but not full symphony volume). The more complex example of FIG. 12 is designed to produce the lowest sounds at loud volumes with low distortion.

FIG. 7.3 is an example of an artificial minimum at 100 Hz. This was produced by keeping the drive signal to Dl constant with frequency and varying only phase in circuit 77. Note that this technique produces a flat response in the 30 to 70 Hz range.

Another benefit not apparent in the data is the absence of the "booming" sound usually found in passive enclosures. They typically have a loud sound at a characteristic resonant frequency. That passive resonant frequency, when excited, causes a resonance at one frequency and possibly some of its harmonics. This "fake" bass prevents natural reproduction of the original sound and can be annoying and unpleasant at higher volumes. The invention controls such resonance by allowing the actual different frequencies of the music to clearly be heard, similar to high quality headphones. In this case the "fake bass" is reduced or eliminated as indicated by FIGS. 3.3*a* and 3.3*b*.

Therefore in this simplest of active designs, the low frequency roll off, distortion, and resonances typical of small enclosures can be partially compensated for by actively applying power, so as to produce a higher quality subwoofer output typical, and in some ways better than that of very large enclosures. This makes higher quality sound practical where there is only room for a small box, as in a car, or on a book shelf.

Figure 8:
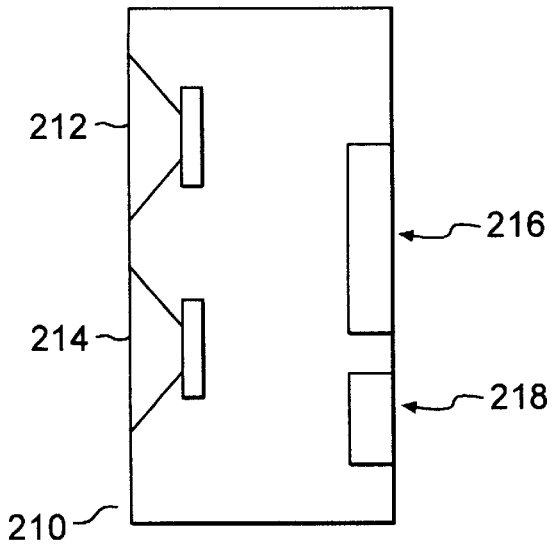
FIG. 8 is an example of the invention using multiple output transducers and multiple cavity pressure control devices.

The invention includes speakers with multiple output transducers and multiple control devices. See, for example, FIG. 8 where the speaker 210 has two output transducers 212, 214 and two cavity pressure control devices 216, 218. Output transducers 212, 214 may be the same or different sizes. Likewise, cavity pressure control devices 216, 218 may be the same or different size. The connections of the transducers 212, 214 to input signals and the connections of pressure control devices 216, 218 to control circuitry are omitted to simplify the figure.

Figure 9:
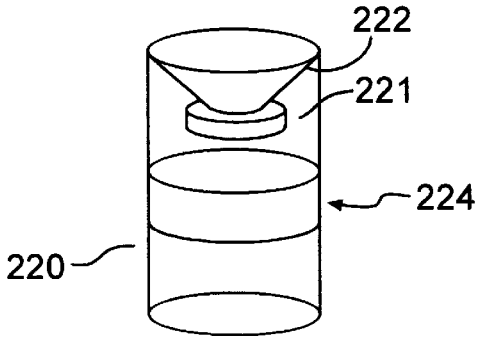
FIGS. 9–11 are examples of the invention in speakers of different shapes.
Figure 10:
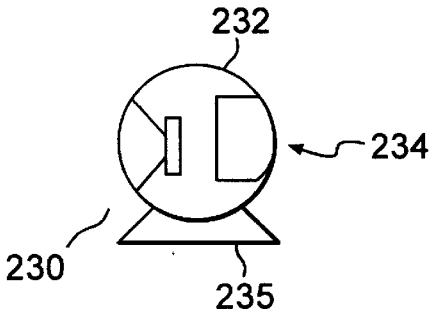
Figure 11:
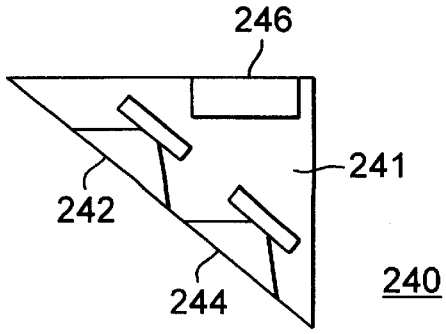

The invention improves performance of a speaker independent of its size and shape. See FIGS. 9–11 where speakers of different shapes include the invention. In FIGS. 9–11 connections to input signals and control circuits are omitted to simplify illustrations. In FIG. 9 a tubular enclosure 220 has a cavity 221 and an output transducer 222 at one end. A cavity pressure control device 224 is mounted in cavity 221 behind the output transducer 222 at one end. A cavity pressure control device 224 is mounted in cavity 221 behind the output transducer 222. The tubular enclosure 220 is a practical shape for automobiles and recreational vehicles. FIG. 10 illustrates the invention in a spherical speaker 230. A output transducer 232 is mounted in an opening in the cavity 231. A cavity pressure control device 234 is mounted behind the transducer 232. A support stand 235 is shaped to hold the spherical speaker 230. FIG. 11 shows a corner speaker 240 with two output transducers 242, 244 mounted at one end of cavity 241 and a cavity pressure control device 246 mounted in the cavity 241 behind the transducers 242, 244.

FIG. 12 shows another working version of the open loop design. The design of FIG. 5.1 was meant to be a small camping speaker capable of producing a low distortion bass with a flat response from 30 to 100 Hz at normal listening levels. The larger and more complex design of FIG. 12 is meant to produce high quality low distortion bass from less than 14 to greater than 100 Hz at full symphony volume. Circuitry has been omitted for simplicity but it is intended to be used in the open loop configuration.

The design of FIG. 12 uses two 12 inch high power speakers, 251 and 252, with a fairly large cavity 254 as D1, to drive a single high quality 12 woofer, 250. The active cavity 253 was made as small as possible. A heavy metal cage bolted inside the enclosure supports speakers 251 and 252. Both cavities as sealed from each other and the outside so that static pressure and gas composition may be controlled and made different from each other and the outside atmosphere. Speakers 251 and 252 must be as similar as possible and see the same acoustic loads if they are driven by the same signals. Different loading on 251 and 252 will create phase shifts and prevent the cavity from reaching a null or good control for other effects. To keep acoustic loading the same the cavity 254 must not be divided, but allows free flow of gas between 251 and 252.

Because of the larger speakers and greater size of cavity 253, the pressures at the top and bottom of output speaker 253 are not equal at some frequencies when using air. This creates unequal pressures across the diaphragm preventing a true null or using other effects to produce the highest quality sound. This can be partially alleviated by using helium in cavity 253 due the much faster speed of sound at room temperature. Helium has the added advantage of conducting heat much better, which can be beneficial in the confined spaces of the cavity under high powers.

As expected this configuration is capable of much higher volumes even at the lowest frequencies. The speaker could be operated using the circuit C1 with similar results except that higher volumes are possible with less distortion than the smaller version of FIG. 5.1. A more complex circuit is needed to make the response flat down to 14 Hz.

While the foregoing examples and embodiments show several ways of implementing the invention, those skilled in the art will appreciate that further modifications, additions, deletions, and changes made be made without departing from the spirit and scope of the invention as set forth in the following claims.

What is claimed is:

1. A sound transducer with an actively controlled cavity comprising:

a speaker enclosure, an aperture and a cavity, said cavity being filled with an acoustic fluid for receiving and transmitting sound;

at least one output transducer mounted over the aperture in the front wall and means coupled to the transducer for reciprocating and producing vibrations in the output transducer, said output transducer generating dynamic changes in pressure of said acoustic fluid in the cavity;

open loop cavity pressure control means for actively controlling instantaneous dynamic pressure in the acoustic fluid in the cavity.

2. The sound transducer of claim 1 wherein the open loop cavity pressure control means nulls the pressure in the cavity over a selected range of frequencies.

3. The sound transducer of claim 1 wherein the open loop cavity pressure control means maintains a nonnull pressure in the cavity over a selected range of frequencies.

4. The speaker of claim 1 wherein said open loop cavity pressure control means comprises a cavity pressure transducer.

5. The speaker of claim 4 wherein the open loop cavity pressure transducer comprises a diaphragm coupled to the inside of the cavity.

6. The speaker of claim 1 wherein the open loop cavity pressure control means reduces the changes in the instantaneous dynamic pressure in the cavity caused by the output transducer.

7. The speaker of claim 1 wherein the open loop cavity pressure control means increases the changes in the instantaneous dynamic pressure in the cavity caused by the output transducer.

8. The speaker of claim 1 having a passive resonance and the open loop cavity pressure control means controls the pressure in the cavity to null the passive resonance.

9. The speaker of claim 6 wherein the cavity pressure control means nulls the changes in the instantaneous dynamic pressure in the cavity over a range of frequencies.

10. The speaker of claim 9 wherein the cavity pressure control means changes distortion of the output transducer.

11. The speaker of claim 10 wherein the cavity pressure control means nulls the cavity pressure to reduce distortion.

12. The speaker of claim 9 wherein the range of frequencies is about between 20 and 100 Hz.

13. The speaker of claim 1 wherein the speaker is sufficiently sealed so as to allow control of pressure to the extent needed to produce desired effects.

14. The speaker of claim 1 comprising two or more output transducers.

15. The speaker of claim 4 comprising two or more cavity pressure control means.

16. A loudspeaker with an actively controlled cavity comprising:

a speaker enclosure with an aperture and a cavity, said cavity being filled with an acoustic fluid for receiving and transmitting sound;

at least one output diaphragm mounted over the aperture in the front wall and driving means coupled to the diaphragm for reciprocating said output diaphragm and responsive to an input drive signal for producing vibrations in the output diaphragm, said output diaphragm generating sound waves in the cavity and dynamic changes in pressure of said acoustic fluid in the cavity;

a cavity pressure transducer mounted in the cavity for actively controlling instantaneous dynamic pressure in the acoustic fluid in the cavity;

one or more cavity sensors mounted in the cavity proximate the output diaphragm for generating electrical signals representative of the frequencies and phase of sound generated in the cavity by the output diaphragm;

a control circuit comprising a circuit selected from the group consisting of an open loop control circuit, a closed loop nonnull control circuit and a combination of an open loop and a closed loop nonnull control circuit coupled between the cavity sensors and the cavity pressure transducer for controlling the operation of the cavity pressure transducer in accordance with the electrical signals generated by the sensors.

17. The speaker of claim 16 wherein the control circuit receives an input signal representative of the drive signal applied to the means for driving the output diaphragm.

18. The speaker of claim 17 wherein the control circuit compares the input drive signal to the cavity signal.

19. The speaker of claim 18 wherein the control circuit comprises an open loop control circuit for nulling the sound produced in the cavity by the first diaphragm.

20. The speaker of claim 18 wherein the control circuit comprises a combination of an open loop control circuit and a closed loop control circuit for nulling the sound produced in the cavity by the output diaphragm.

21. The speaker of claim 18 wherein the control circuit comprises a closed loop circuit for reinforcing the sound produced in the cavity by the output diaphragm.

22. The speaker of claim 18 wherein the control circuit comprises a closed loop circuit for decreasing the sound produced in the cavity by the output diaphragm.

23. The speaker of claim 18 wherein the control circuit comprises an open loop control circuit for nulling first frequencies, reinforcing second frequencies and reducing third frequencies of the sound produced in the cavity by the output diaphragm control circuit for nulling the sound produced in the cavity by the first diaphragm.

24. The speaker of claim 18 wherein the control circuit comprises a closed loop nonnull control circuit for nulling first frequencies, reinforcing second frequencies and reducing third frequencies of the sound produced in the cavity by the output diaphragm.

25. The speaker of claim 16 wherein the control circuit comprises an open loop control circuit for nulling the sound produced in the cavity by the output diaphragm.

26. The speaker of claim 18 wherein the cavity pressure control means reduces distortion produced by the output diaphragm.

27. The speaker of claim 26 wherein the control circuit comprises an open loop control circuit for operating the cavity pressure control means to null the cavity pressure to reduce distortion produced by the output diaphragm.

28. The speaker of claim 18 wherein the control circuit generates a pressure transducer control signal having one or more controllable characteristics.

29. The speaker of claim 28 wherein the controllable characteristics comprise one or more characteristics selected from the group consisting of phase, frequency, waveshape, and amplitude.

30. The speaker of claim 18 wherein the control circuit comprises an open loop control circuit and the speaker has a passive resonance and the cavity pressure control means controls the pressure in the cavity to null the passive resonance.

31. The speaker of claim 18 further comprising a closed loop control circuit.

32. A method for actively controlling the dynamic pressure in a speaker cavity comprising the steps of:

applying a drive signal to a first speaker in a speaker cavity and generating sound in the cavity that changes the dynamic pressure in the cavity;

open loop controlling the changes in the dynamic pressure in the cavity.

33. The method of claim 32 wherein the dynamic pressure changes in the cavity are controlled to null the changes.

34. The method of claim 32 wherein the dynamic pressure changes in the cavity are controlled to reinforce and increase the dynamic pressure changes produced by the first diaphragm.

35. The method of claim 32 wherein the dynamic pressure changes in the cavity are controlled to decrease the dynamic pressure changes produced by the first diaphragm.

36. The method of claim 32 further comprising the step of sensing the dynamic pressure changes in the cavity and changing the pressure in the cavity to null, reinforce and decrease selected frequencies of the sound in the cavity.

37. The method of claim 32 wherein the speaker has a passive resonance and the changes in dynamic pressure in the cavity are controlled to null the passive resonance.

38. A loudspeaker with an actively controlled cavity comprising:

a speaker enclosure with an aperture and a first cavity, said first cavity being filled with an acoustic fluid for receiving and transmitting sound;

at least one output diaphragm mounted over the aperture in the front wall and driving means coupled to the diaphragm for reciprocating said output diaphragm and responsive to an input drive signal for producing vibrations in the output diaphragm, said output diaphragm generating sound waves in the first cavity and dynamic changes in pressure of said acoustic fluid in the first cavity;

one or more first cavity pressure transducers mounted in the first cavity for actively controlling instantaneous dynamic pressure of the acoustic fluid in the first cavity;

open loop phase shift control means for receiving the input drive signal, phase shifting the input drive signal and applying the phase shifted drive signal to the first cavity pressure transducer(s) for controlling the pressure of the acoustic fluid in said first cavity.

39. The speaker of claim 38 wherein the open loop phase shift control means comprises a phase shift control circuit.

40. The speaker of claim 39 wherein the phase shift control circuit further comprises means for controlling the amplitude of the control signal applied to the first cavity pressure transducer.

41. The speaker of claim 39 wherein the phase shift control circuit further comprises means for controlling the frequencies of the control signal applied to the first cavity pressure transducer.

42. The speaker of claim 41 wherein the frequency control means comprises means for applying one or more harmonic frequencies of the input drive signal to the first cavity transducer.

43. The speaker of claim 39 comprising a plurality of phase shift control circuits, each one tuned to phase shift a selected range of frequencies of the input drive signal.

44. The speaker of claim 38 wherein the phase shift control means comprises a digital signal processor for receiving the input drive signal, for phase shifting one or more frequencies of said input drive signal and for applying the phase shifted input drive signal to the first cavity transducer.

45. The speaker of claim 38 further comprising sensors in the first cavity and a negative feed back path connected at one end to the sensors and at the other end to the open loop phase control circuit for closing said open loop and for operating the speaker in a nonnull mode of operation.

46. The speaker of claim 38 further comprising sensors in the first cavity and a negative feed back path connected at one end to the sensors and at the other end to the first cavity pressure transducer for operating together with the open loop phase control means to control the pressure in the first cavity.

47. The speaker of claim 38 further comprising a second cavity sealed from the first cavity wherein the pressure transducer(s) are disposed between the first and second cavities.

48. The speaker of claim 47 wherein the second cavity is filled with an acoustic fluid different from ambient fluid outside the speaker.

49. The speaker of claim 47 wherein the second cavity is filled with an acoustic fluid different from the acoustic fluid in the first cavity.

50. A sound transducer with an actively controlled cavity comprising:

a speaker enclosure, an aperture and a cavity, said cavity being filled with an acoustic fluid for receiving and transmitting sound;

at least one output transducer mounted over the aperture in the front wall and means coupled to the transducer for reciprocating and producing vibrations in the output transducer, said output transducer generating dynamic changes in pressure of said acoustic fluid in the cavity;

closed loop cavity pressure control means for actively controlling instantaneous dynamic pressure in the acoustic fluid in the cavity to have an instantaneous pressure different from ambient pressure outside cavity; and an open loop cavity pressure control means for independently changing the pressure in the cavity.

51. The speaker of claim 50 wherein said open loop cavity pressure control means comprises a cavity pressure transducer.

52. The speaker of claim 51 wherein the cavity pressure transducer comprises a diaphragm coupled to the inside of the cavity.

53. The speaker of claim 50 wherein the open loop cavity pressure control means reduces the changes in the instantaneous dynamic pressure in the cavity caused by the output transducer.

54. The speaker of claim 50 wherein the open loop cavity pressure control means increases the changes in the instantaneous dynamic pressure in the cavity cause4d by the output transducer.

55. The speaker of claim 50 having a passive resonance and the open loop cavity pressure control means controls the pressure in the cavity to null the passive resonance.

56. The speaker of claim 50 comprising two or more open loop cavity pressure control means.

* * * * *

UNITED STATES PATENT AND TRADEMARK OFFICE

CERTIFICATE OF CORRECTION

PATENT NO. : 6,353,670 B1
DATED : March 5, 2002
INVENTOR(S) : Donald R. Gasner

It is certified that error appears in the above-identified patent and that said Letters Patent is hereby corrected as shown below:

Title page,
Item [54], Title, please correct the title of the above issued patent to read as follows:
-- ACTIVELY CONTROLLED SOUND TRANSDUCER --

Signed and Sealed this

Nineteenth Day of November, 2002

*Attest:*

*Attesting Officer*

JAMES E. ROGAN
*Director of the United States Patent and Trademark Office*